United States Patent [19]

Masaka et al.

[11] Patent Number: 4,661,048

[45] Date of Patent: Apr. 28, 1987

[54] ELECTROMAGNETIC PUMP WITH SIMPLIFIED CONSTRUCTION

[75] Inventors: Mitusuke Masaka, Kawagoe; Takatoshi Arai, Hiki, both of Japan

[73] Assignee: Jidosha Kiki Co., Ltd., Tokyo, Japan

[21] Appl. No.: 785,412

[22] Filed: Oct. 7, 1985

[30] Foreign Application Priority Data

Nov. 7, 1984 [JP] Japan ..... 59-168009[U]

[51] Int. Cl.[4] ..... F04B 17/04

[52] U.S. Cl. ..... 417/360; 417/417; 310/30

[58] Field of Search ..... 417/417, 360; 310/30

[56] References Cited

U.S. PATENT DOCUMENTS

| | | | |
|---|---|---|---|
| 3,381,616 | 5/1968 | Wertheimer | 417/417 |
| 4,299,544 | 11/1981 | Masaka | 417/417 |
| 4,306,843 | 12/1981 | Arai | 417/417 |
| 4,389,189 | 6/1983 | De Dionigi | 417/417 |

FOREIGN PATENT DOCUMENTS

| | | | |
|---|---|---|---|
| 2465903 | 4/1981 | France | 417/417 |
| 5720832 | 2/1979 | Japan . | |

*Primary Examiner*—Carlton R. Croyle
*Assistant Examiner*—Theodore Olds
*Attorney, Agent, or Firm*—Townsend & Townsend

[57] ABSTRACT

An electromagnetic pump includes a coil bobbin with an excitation coil, a pair of magnetic cylinders, a printed circuit board with a transistor, and a pump housing. The coil bobbin is disposed around a sleeve member having a plunger therein. The pair of magnetic cylinders are axially inserted from two ends of the bobbin between the inner surface of the coil bobbin and the outer surface of the sleeve member. The pump housing consists of a cup-like housing body and a lid. The plunger, the magnetic cylinders and the pump housing are made of a magnetic material to form a magnetic flux path from the excitation coil.

3 Claims, 5 Drawing Figures

ELECTROMAGNETIC PUMP WITH SIMPLIFIED CONSTRUCTION

BACKGROUND OF THE INVENTION

The present invention relates to an improvement in an electromagnetic pump of a type used for fuel supply in a vehicle.

A simple electromagnetic pump as a vehicle fuel supply pump which allows easy machining and assembly of parts and provides stable pumping has been desired. Conventional electromagnetic pumps have both advantages and disadvantages and fail to satisfy all the needs described above.

In a conventional electromagnetic pump of this type, as described in Japanese Utility Model Publication No. 57-20832, a sleeve member is fitted in a cylindrical housing having a U-shaped magnetic housing member, and a plunger is slidably fitted in the sleeve member. Inlet and outlet cylindrical members are mounted at two ends of the pump housing. This electromagnetic pump is called a rectangular type electromagnetic pump. In this conventional pump, a coil bobbin having an excitation coil thereon is loosely fitted in the sleeve member in the housing. Small-diameter cylindrical portions formed at inner ends of the inlet and outlet cylindrical members are fitted between the coil bobbin and the sleeve member. A magnetic flux path from the excitation coil is formed such that the plunger is reciprocally driven by the pump housing and the inlet and outlet cylindrical members in the sleeve. In particular, since the small-diameter portions properly constitute the magnetic flux path, the total magnetic efficiency can be improved to optimize pumping.

The conventional electromagnetic pump of the structure described above has a large number of constituting parts and a complicated structure. Machining and assembly are time-consuming and cumbersome. As a result, a compact, lightweight, low-cost electromagnetic pump cannot be provided.

With the above structure, as a member for forming the magnetic flux path necessary to achieve proper, smooth reciprocal movement of the plunger by means of the magnetic force from the excitation coil, the pump housing is machined as a U-shaped member by bending a relatively thick magnetic plate. Inner ends of the inlet and outlet cylindrical members are cut as the small-diameter portions. Manufacture of these parts is time-consuming and cumbersome, resulting in high cost. In addition, high precision cannot be assured. In a worst case, the sleeve member becomes deformed so that proper operation of the plunger cannot be guaranteed.

According to another conventional electromagnetic pump without the small-diameter portions of the inlet and outlet members, as described in Japanese Utility Model Publication No. 52-36964, a sleeve member has a plunger extending therethrough and is held by a coil bobbin. Thick magnetic plates (i.e., yokes) are arranged at two ends of the coil bobbin. With this structure, however, a magnetic plate as a magnetic flux path constituting member is required to increase a total number of constituting parts, the overall structure is complicated, and assembly is cumbersome. Since the magnetic plate is inserted between the coil bobbin and a printed circuit board, a projection is formed on a coil bobbin to insulate the printed circuit board from the magnetic plate when the coil is led from the coil bobbin to the printed circuit board. A thin insulating film such as a polyester or enamel film must be formed on the coil. Since such a film is very thin, electrical insulation between the coil and the magnetic plate and various electronic parts must be considered. The magnetic plate may be short-circuited with the electronic components, so that a wide space must be guaranteed therebetween. As described above, since the magnetic plate is relatively thick, a compact and lightweight pump cannot be prepared and the magnetic efficiency for driving the plunger is also degraded. As a result, efficient and accurate pumping cannot be obtained.

Electromagnetic pumps of this type have been mounted in small vehicles of 1,000 cc stroke volume, so that a demand has arisen for a compact, lightweight, low-cost pump. No conventional electromagnetic pumps can answer the above demand and much room is left for improvements. In reviewing the overall structure of the electromagnetic pump, demand has arisen for further improvements: simplification of the respective components, reduction in the number of parts so as to facilitate machining and assembly as well as an increase in operation reliability, thereby obtaining a compact, lightweight, low-cost electromagnetic pump.

SUMMARY OF THE INVENTION

It is, therefore, a principal object of the present invention to provide a compact, lightweight, low-cost electromagnetic pump as compared with a conventional pump of this type.

It is another object of the present invention to provide a simple electromagnetic pump with a small number of constituting parts.

It is still another object of the present invention to provide an electromagnetic pump wherein machining and assembly efficiency can be greatly improved together with high operation reliability.

It is still another object of the present invention to provide an electromagnetic pump wherein the respective parts are sealed in a pump housing of a simple structure.

In order to achieve the above objects of the present invention, there is provided an electromagnetic pump comprising: a coil bobbin wound with an excitation coil and disposed around a sleeve member having a plunger therein; a pair of magnetic cylinders axially inserted from two ends of the coil bobbin between an inner surface of the coil bobbin and an outer surface of the sleeve member to constitute a magnetic flux path; a printed circuit board arranged at one side of the coil bobbin and mounted with a transistor and various electronic components; and a pump housing consisting of a cup-like housing body and a lid for closing an opening of the housing body, the pump housing being adapted to enclose the coil bobbin, the pair of magnetic cylinders and the printed circuit board and hold the pair of magnetic cylinders mounted at the two ends of the sleeve member, the pump housing being made of a magnetic material to form the magnetic flux path together with the pair of magnetic cylinders.

DESCRIPTION OF THE PREFERRED EMBODIMENT

The present invention will be described with reference to a preferred embodiment of the present invention in conjunction with the accompanying drawings.

Figure 1:
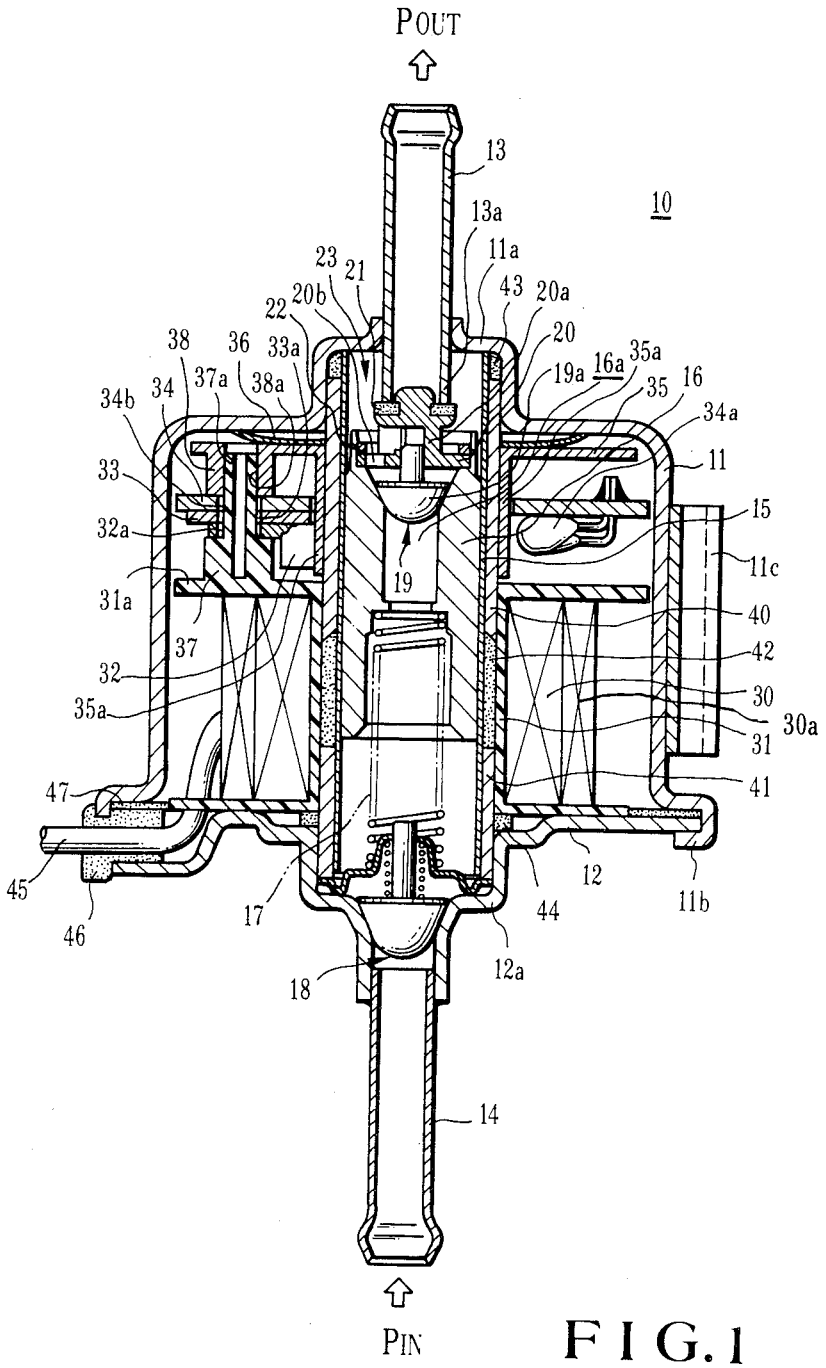
FIG. 1 is a longitudinal sectional view showing an assembly of an electromagnetic pump according to an embodiment of the present invention.
Figure 2:
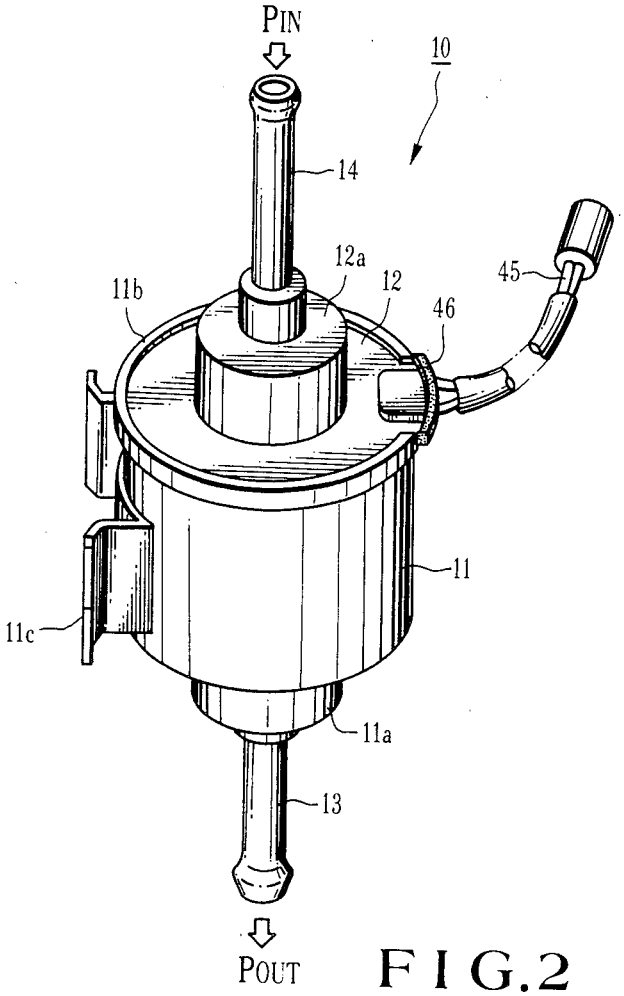
FIG. 2 is a schematic perspective view showing the outer appearance of the electromagnetic pump of FIG. 1.

FIGS. 1 and 2 show an electromagnetic pump according to an embodiment of the present invention. The schematic structure of an electromagnetic pump 10 will be briefly described. The electromagnetic pump 10 has a cup-like housing body 11 and a disk-like lid 12 for closing the opening of the housing body 11. The body 11 and the lid 12 constitute a pump housing. Cylindrical portions 11*a* and 12*a* are formed integrally with the central portion of the bottom (upper side in FIG. 1) of the body 11 and the central portion of the lid 12, respectively. Pipes 13 and 14 constituting fluid outlet and inlet ports are brazed at the centers of the cylindrical portions ll*a* and 12*a*. The body 11 and the lid 12 can be easily formed by pressing a magnetic material (metal plates). An edge ll*b* defining the opening of the body 11 is caulked to the lid 12. The body 11 and the lid 12 of the pump housing also serve as yokes for forming a magnetic path from an excitation coil (to be described later). An inner space defined by the body 11 and the lid 12 houses mechanical and electrical components of the pump. As shown in FIG. 2, a bracket ll*c* is used to mount the electromagnetic pump 10 to a vehicle body.

A nonmagnetic sleeve member 15 is inserted between the cylindrical portion ll*a* of the body 11 and the cylindrical portion 12*a* of the lid 12. A magnetic plunger 16 with a through hole 16*a* is slidably inserted in the sleeve member 15 and is always biased by a return spring 17 arranged at the inlet port side toward the outlet port of the housing. Reference numeral 18 denotes a suction valve mounted at the inlet end of the sleeve member 15; and 19, a delivery valve mounted at the outlet end of the plunger 16. A valve body 19*a* of the delivery valve 19 is slidably supported in a central cylindrical portion 20*a* of a ring-like member 20 constituting the fuel leakage prevention control valve fixed integrally with the end of the plunger 16. The member 20 has a function of guiding the valve body 19*a* of the delivery valve 19. A rubber or plastic valve seat 21 is disposed at the outer end of the cylindrical portion 20*a* to open/close the inner end of the pipe 13 which extends inside the sleeve member 15 from the outlet port side for a predetermined length. A stopper ring 22 is disposed to fix the member 20 to the end of the plunger 16 The member 20 has four arcuated holes 20*b* to allow fluid to pass therethrough. The holes 20*b* are formed in a peripheral portion of the member 20 at equiangular intervals. The fuel leakage prevention control valve is moved together with the plunger 16 in the sleeve member 15. When the electromagnetic pump is not operated, the control valve closes an inner end 13*a* of the pipe 13 by the biasing force of the return spring 17, thereby properly preventing fluid from leaking to the outlet port and hence providing a practical effect (i.e., guaranteeing safety of the driver and passengers in a vehicle).

According to the present invention, in order to form the control valve, the inner end 13*a* of the delivery pipe 13 extends inside the sleeve member 15 for a predetermined length to form an annular space serving as an annular pulsation absorption chamber 23 around the pipe 13.

A plastic coil bobbin 31 having an excitation coil 30 and a detection coil 30*a* wound therearound is arranged around the sleeve member 15 housing the plunger 16. A transistor 32 and a heat sink 33 are integrally arranged and spaced a predetermined distance apart from an outer surface portion of a flange 31*a* (upper side in FIG. 1). The transistor 32 partially constitutes an oscillator for flowing a current to the excitation coil 30. A printed circuit board 34 and a holder 35 are spaced a predetermined distance apart from each other along a direction perpendicular to the surface of the heat sink 33. The printed circuit board 34 has various electronic elements 34*a* such as a resistor and a diode which constitute the oscillator together with the transistor 32. The stacked assembly of components making up the pump is housed in the body 11 constituting the pump housing such that the front end of the stacked assembly is located at the holder 35 side in the body 11. The assembly is elastically supported in the body 11 by a leaf spring 36 inserted at the bottom of the body 11.

With this arrangement, the assembly of the transistor 32 and the printed circuit board 34 can be simplified, and the electronic elements 34*a* on the printed circuit board 34 will not be short-circuited.

A plurality of studs 37 extend on one outer surface of the the flange 31*a* of the coil bobbin 31 to support the transistor 32 and the heat sink 33 as well as the printed circuit board 34 at a predetermined distance from the above-mentioned surface of the flange 31*a*. A plurality of studs 38 extend on the inner side surface of the holder 35 to oppose the studs 37. Reference numeral 37*a* denotes a small-diameter front portion of each stud 37. The small-diameter portion 37*a* is inserted into holes 32*a*, 33*a* and 34*b* which are respectively formed in the transistor 32, the heat sink 33 and the printed circuit board 34 to inhibit their movement along the radial direction of the pump. Furthermore, each small-diameter portion 37*a* is inserted into a hole 38*a* formed in the corresponding stud 38 at the side of the holder 35, thereby forming the assembly as an integral body. Reference numeral 35*a* denotes a cylindrical portion formed at the center of the holder 35 to hold the sleeve member 15. In this embodiment, the printed circuit board 34 and the holder 35 have substantially a ring-like shape which matches with the coil bobbin 31. The heat sink 33 has a sector-shaped member of a size sufficient to allow mounting of the transistor 32 on the printed circuit board 34.

Rotation of the stacked assembly including the coil bobbin 31 housed in the pump housing is prevented by utilizing a frictional force between adjacent members or by providing an anti-rotational engaging member between the coil bobbin 31 and the lid 12. With this arrangement, the heat sink 33 can be brought into contact with the inner wall of the body 11 so as to allow proper radiation of heat from the transistor 32.

Figure 4A:
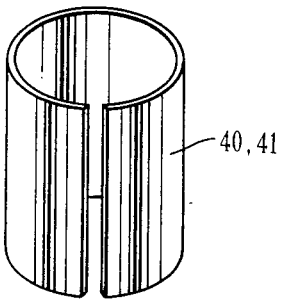
FIGS. 4A and 4B are perspective views showing modifications of a magnetic cylinder in the electromagnetic pump of FIG. 1.
Figure 4B:
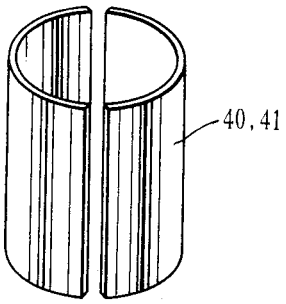

In the electromagnetic pump 10 having the arrangement described above, a pair of magnetic cylinders 40 and 41 for forming the magnetic flux path from the excitation coil 30 are inserted from two ends along the axial direction to form a magnetic path from the excitation coil 30. The magnetic cylinders 40 and 41 are sandwiched between the outer surface of the sleeve member 15 housing the plunger 16 and the inner surface of the coil bobbin 31 having the excitation coil 30 wound therearound. The magnetic cylinders 40 and 41 comprise coiled bushes or split bushes obtained by bending a plate material, as shown in FIGS. 4A and 4B, thereby simplifying machining and assembly. Seal members 42, 43 and 44 are properly inserted between the inner path of the sleeve member 15 and the inner space of the pump housing to block fuel, so that a complete seal can be obtained since the magnetic cylinders 40 and 41 comprise coil or split bushes.

The above-mentioned magnetic cylinders 40 and 41 are inserted between the outer surface of the sleeve member 15 and the inner surface of the coil bobbin 31 from both ends, and the plunger 16 therein is reciprocally moved by the magnetic force of the excitation coil 30. When the magnetic cylinders comprise conventional cylindrical members obtained by cutting, machining is time-consuming and burdensome, and precision machining cannot be performed, resulting in high cost. The present invention eliminates such drawbacks. When coiled or split bushes easily obtained by winding a plate member are used, machining can be greatly facilitated, high precision machining is not required, and assembly is simplified. As a result, the electromagnetic pump can be manufactured at low cost.

When the coiled or split bush is used as the magnetic cylinder, a gap is formed along the axial direction thereof and fluid flowing through the sleeve member 15 leaks into the pump housing. In order to resolve this difficulty, the cylindrical seal member 42 shown in FIG. 1 is mounted on the outer surface of the sleeve member 15, and the magnetic cylinders 40 and 41 are inserted in the sleeve member 15 from the both ends, thereby guaranteeing a seal between the sleeve member 15 and the coil bobbin 31. At the same time, seal members 43 and 44, such as O-rings, are inserted at the two ends of the sleeve member 15 between the housing body 11 and the lid 12 which constitute the pump housing. Thus, complete sealing can be achieved.

With this arrangement, the magnetic cylinders 40 and 41 need comprise only coiled or split bushes obtained by winding a plate member, so that machining can be simplified. Even if a small gap is formed along the axial direction of the bush, no problem occurs. High precision is not required in production, assembly efficiency can be greatly improved, and the manufacturing cost can be significantly decreased.

With the above arrangement, when at least one of the magnetic cylinders 40 and 41 is engaged with the cylindrical portion ll*a* or 12*a* of the housing body 11 and the lid 12 which hold the two ends of the sleeve member 15 to form a gap between the cylindrical portions ll*a* and 12*a*, concentric and parallel errors between the housing body 11 and the lid 12 can be absorbed. Sticking of the plunger 16 which is caused by deformation of the sleeve member 15 can be prevented.

Reference numeral 45 denotes lead wires extending from the excitation coil 30 through a grommet 46 led from part of a junction portion between the housing body 11 and the cover 12; and 47, a gasket for sealing between the housing body 11 and the cover 12. Other arrangements of the electromagnetic pump are known to those skilled in the art, and a detailed description thereof will be omitted.

According to the present invention, the electromagnetic pump 10 is characterized in that a magnetic material is used to constitute the coin bobbin 31 wound with the excitation coil 30 and the detection coil 30*a*, the pair of magnetic cylinders 40 and 41 inserted from axial ends between the inner surface of the coil bobbin 31 and the outer surface of the sleeve member 15 to constitute the magnetic flux path from the excitation coil 30, and the cup-like housing body 11 and the lid 12 which constitute the pump housing having pump constituting parts such as the transistor 32 arranged at one end of the coil bobbin 31 and the printed circuit board 34 surface-mounted with various electronic parts 34*a*. Without using magnetic plates to form a magnetic flux path at two ends of the coil bobbin 31, a magnetic flux path from the excitation coil 30 can be formed.

It is very important to design an effective layout of electronic parts including the coil bobbin 31 wound with the excitation coil 30, the transistor 32 and the printed circuit board 34, thereby achieving a simple, compact, lightweight, low-cost electromagnetic pump. In this case, the constituting members used to generate the magnetic flux from the excitation coil 30 are important. According to the present invention, the magnetic plates conventionally arranged at two ends of the coil bobbin are eliminated. Instead, the cup-like housing body 11 and the lid 12 which constitute the pump housing are combined with the pair of magnetic cylinders 40 and 41 and the plunger 16 to form the magnetic flux path. The plunger 16 can be properly reciprocated by the magnetic force and the biasing force of the return spring 17.

With the above structure, the number of constituting parts can be greatly decreased, the overall structure can be simplified, and the respective components can be easily manufactured and assembled.

An ON/OFF current generator used in the electromagnetic pump 10 will be briefly described with reference to FIG. 3. Reference numeral 50 denotes a resistor for protecting the transistor 32 from a large current even if the power source is reverse-connected; 51, a bias resistor; 52 and 53, diodes, respectively; and 54, a surge absorber for absorbing a surge voltage. In this arrangement, the transistor 32 comprises an npn transistor which is inexpensive.

Figure 3:
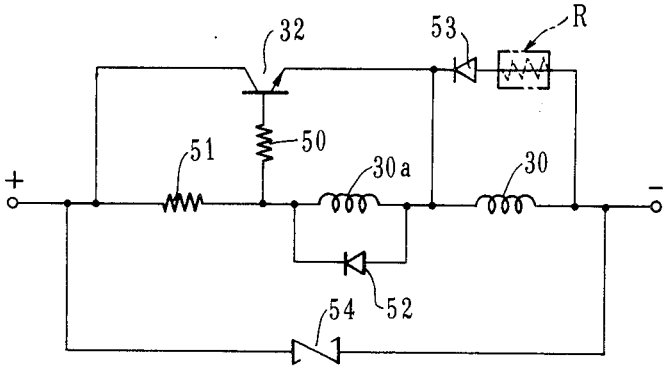
FIG. 3 is a circuit diagram of an on/off current generator used in the electromagnetic pump of FIG. 1.

With the circuit arrangement described above, unlike in a conventional circuit requiring a resistor represented by reference numeral R for pumping, the resistor can be omitted from the circuit shown in FIG. 3. According to the electromagnetic pump 10 of this embodiment, the diameter of the plunger 16 is smaller than that of the excitation coil 30, and at the same time the wire of the excitation coil 30 and the detection coil 30*a* is made thin, and the number of turns thereof is also decreased. Furthermore, since thick magnetic plates are not arranged at the two ends of the coil bobbin 31, the magnetic member around the coil 30 can be decreased in size. As a result, the magnetic flux path area is narrowed, decreasing the magnetic flux flow. Thus, an inductance L of the coil 30 is increased, and hence the operating frequency n of the blocking oscillator is increased as compared with that of the conventional arrangement. Although the conventional circuit requires the resistor R to increase the operating frequency, the circuit of this embodiment can omit the resistor R since a high operating frequency is guaranteed.

A delivery quantity Q in the electromagnetic pump 10 can be derived as follows:

$$Q = 60nAS - q$$

where A is the sectional area of the plunger 16, S is the stroke of the plunger 16, and q is the leakage quantity in the interior of the pump.

When the sectional area A and the stroke S are decreased, the operating frequency n must be increased to guarantee a sufficient delivery quantity Q.

In brief, when the operating frequency n is increased, satisfactory pumping performance in practice can be guaranteed.

The present invention is not limited to the particular embodiment described above. Various changes and modifications of the shape and structure of the respective components of the pump can be made within the spirit and scope of the invention.

As is apparent from the above description, according to the electromagnetic pump of the present invention, the pump housing which houses the sleeve member having the plunger therein, the coil bobbin wound with the excitation coil, the transistor arranged at one end of the coil bobbin, and the printed circuit board surface-mounted with various electronic parts is constituted by the magnetic cup-like housing body and the lid for closing the opening of the pump housing body. Without using magnetic plates at the two ends of the coil bobbin so as to form a magnetic flux path, such a path from the magnetic coil can be formed. The electromagnetic pump of the present invention has a simple structure and a small number of components. The respective components can be easily manufactured and assembled, and operation reliability can be improved. Therefore, a compact, lightweight pump can be manufactured at low cost.

Furthermore, by only increasing the operating frequency of the excitation coil, proper pumping is achieved by efficient and optimal reciprocal movement of the plunger. The operating frequency can be increased without a resistor in the ON/OFF current generator. The number of constituting parts and the manufacturing cost can therefore be further decreased. According to the present invention, since the conventional magnetic plates for forming the magnetic flux path can be omitted, a complex structure and an excessive space which are required to prevent short-circuiting between the magnetic plates and the coil, and between the magnetic plates and the electronic components can be omitted, thus further contributing to compactness and low cost.

What is claimed is:

1. An electromagnetic pump comprising:

an electrically insulative coil bobbin wound with an excitation coil and disposed around a sleeve member having a plunger therein;

a pair of magnetic cylingers axially inserted from two ends of said coil bobbin between an inner surface of said coil bobbin and an outer surface of said sleeve member to constitute a magenetic flux path;

a printed circuit board arranged at one side of said coil bobbin and mounted with a transistor and various electronic components; and a pump housing consisting of a cup-like housing body and a lid for closing an opening of said housing body, said pump housing being adapted to enclose said coil bobbin, said pair of magnetic cylinders and said printed circuit board and to hold said pair of magnetic cylinders mounted at said two ends of said sleeve member, said pump housing being made of a magnetic material to form the magnetic flux path together with said pair of magnetic cylinder, said housing body and said lid each having a centrally located outwardly extending integrally formed recessed region for securing the respective ends of said sleeve member and said pair of magnetic cylinders, so that said bobbin, said printed circuit board, said sleeve member and said cylinders can be quickly and conveniently mounted in said housing.

2. A pump according to claim 1, which further comprises a seal member arranged along the outer surface of said sleeve member between said pair of magnetic cylinders.

3. A pump according to claim 1, wherein said pair of magnetic cylinders comprise coil or split bushes, respectively, each of said coil or split bushes being formed by bending a magnetic sheet.

* * * * *